US005927637A

United States Patent [19]

Gerhards

[11] Patent Number: 5,927,637

[45] Date of Patent: Jul. 27, 1999

[54] YARN WINDING BOBBIN

[75] Inventor: Klaus Gerhards, Hückeswagen, Germany

[73] Assignee: Barmag AG, Remscheid, Germany

[21] Appl. No.: 08/969,669

[22] Filed: Nov. 13, 1997

[30] Foreign Application Priority Data

Nov. 13, 1996 [DE] Germany ..... 196 46 870

[51] Int. Cl.[6] ..... B65H 75/28

[52] U.S. Cl. ..... 242/476.6; 242/125.1; 242/476.5

[58] Field of Search ..... 242/125.1, 476.1, 242/476.5, 476.6

[56] References Cited

U.S. PATENT DOCUMENTS

| | | | |
|---|---|---|---|
| 3,284,023 | 11/1966 | Sowell | 242/125.1 |
| 4,014,476 | 3/1977 | Turk et al. | 242/125.1 X |
| 4,018,401 | 4/1977 | Cunningham | 242/125.1 X |
| 4,101,086 | 7/1978 | Thomas, Jr. | 242/125.1 X |
| 4,477,034 | 10/1984 | Oswald | 242/476.6 |
| 4,867,385 | 9/1989 | Lenk . | |
| 4,880,183 | 11/1989 | Kubata et al. | 242/125.1 |
| 5,029,762 | 7/1991 | Behrens et al. | 242/125.1 X |
| 5,248,111 | 9/1993 | Teckentrup et al. | 242/125.1 |
| 5,328,121 | 7/1994 | Rummage | 242/125.1 |

FOREIGN PATENT DOCUMENTS 39 23 305 2/1990 Germany .

*Primary Examiner*—Michael Mansen
*Attorney, Agent, or Firm*—Alston & Bird LLP

[57] ABSTRACT

A yarn winding bobbin having a tubular wall and which includes a yarn catching slot so that the bobbin is able to catch a continuously advancing yarn during a bobbin changing operation on a continuous winding machine. The yarn catching slot is configured to catch the yarn as the yarn and surface of the bobbin move in the same direction, and it includes a tongue for initially engaging the yarn and a clamping slot into which the yarn is guided by the tongue.

11 Claims, 3 Drawing Sheets

YARN WINDING BOBBIN

BACKGROUND OF THE INVENTION

The present invention relates to a yarn winding bobbin adapted for use on continuous winding machines and which has a yarn catching slot of novel construction.

EP 524,545 and corresponding U.S. Pat. No. 5,248,111 disclose a yarn winding bobbin having a slot designed to catch the running yarn during the yarn transfer operation of a continuous winding machine. More particularly, the running yarn is laid on the winding bobbin in such a way that the direction of movement of the yarn corresponds to the direction of movement of the surface of the winding bobbin. This so-called "same direction catching" has the advantage that the yarn being delivered to the full package does not slip at the instant when the yarn is laid on to the empty winding bobbin, note EP 374 536 and corresponding U.S. Pat. No. 5,029,762. For this purpose, the winding bobbin has a catching slot, lying in a normal plane, which consists of a through opening and a clamping slot following in the circumferential direction. Fashioned on one of the side flanks of the through opening is a catching tongue which catches the yarn running on a secant of the inner circumference when the winding bobbin is rotated further, thereby preventing the yarn from rising radially out of the catching slot. As movement progresses, the yarn is deflected by the catching tongue, so that the yarn is drawn into the clamping slot located at the yarn delivery end of the through opening.

Since, in the case of same direction catching, no relative movement occurs between the yarn and the winding bobbin, the yarn can only be drawn into the clamping slot by being wrapped on the catching tongue. It has been shown that, particularly in the case of BCF yarns, which normally lie within the titer range of 500 to 4,000 dtex, the yarn is not drawn into the clamping slot. Due to the high inherent dynamic forces acting on the yarn, the yarn repeatedly becomes unwrapped and rises radially out of the catching slot.

An object of the invention, therefore, is to further develop a winding bobbin of the type referred to in such a way that even yarns with larger titers are reliably caught.

SUMMARY OF THE INVENTION

The above and other objects and advantages of the present invention are achieved by the provision of a yarn bobbin which comprises a cylindrical tubular wall defining a longitudinal axis and opposite ends. A yarn catching slot is formed in the wall adjacent or in communication with one of the ends and extends in a circumferential direction and completely through the wall in a radial direction. The slot includes a side flank which is disposed substantially perpendicular to the axis, and a yarn catching tongue extends from the side flank in a generally axial direction and includes a yarn engaging edge which faces in the intended direction of rotation of the bobbin. Further, a clamping slot is formed at the intersection of the yarn engaging edge and the side flank of the yarn catching slot and extends a substantial distance away from the intersection.

Thus in accordance with the invention, the clamping slot is positioned in the transition region between the catching tongue and a cut-out of the through opening which defines the side flank, and the clamping slot runs transversely relative to the yarn catching slot. Also, the yarn engaging edge of the yarn catching tongue is preferably inclined so as to form an acute angle with the side flank, so that the engaged yarn will be caused to slide into and be engaged by the clamping slot.

DE 39 23 305 discloses a winding bobbin wherein a yarn catching slot is formed from an engaging part and a clamping part of the bobbin wall, with no through opening of the bobbin wall being provided. The yarn traps fashioned in the engaging part in particular are hardly suitable for the reliable retention of yarns in the stated titer range. Furthermore, only limited clamping forces can be exerted on the yarn by means of the clamping slot fashioned on the surface.

By contrast, the winding bobbin according to the invention offers the advantage that the yarn is drawn into the clamping slot as soon as it is wrapped on to the catching tongue. The yarn trap and the clamping slot are directly adjacent so that, as the rotation of the winding bobbin progresses, the yarn is increasingly drawn into the clamping slot. The yarn is fixed in position in the clamping slot. Since the yarn has wrapped around the catching tongue where it is fixed in position, the tensile forces in the yarn increase very rapidly due to the rotational movement of the full package and the empty winding bobbin, and the yarn ultimately breaks at a point between the full package and the empty winding bobbin. The free end of the yarn can then also be wound on to the full package. In the case of larger titers, the yarn is guided against a blade edge and severed.

A particularly advantageous embodiment of the invention provides for the clamping slot to be in alignment with the yarn engaging edge of the catching tongue. By this means, the yarn is routed from the wrap contact with the catching tongue directly into the clamping slot.

The clamping slot preferably passes completely through the tubular wall of the bobbin in the radial direction. This provides the advantage that both the clamping forces and the frictional forces resulting from the winding of the yarn act on the yarn at the same point. Consequently, as the rotation of the winding bobbin progresses, the yarn will break just behind the clamping slot.

The clamping slot also preferably lies in a plane which is substantially perpendicular to the tangential plane lying in the point of intersection between the clamping slot and the bobbin outer surface. This construction provides the advantage that, upon emerging from the clamping slot, the yarn undergoes a very sharp deflection. As a result, the yarn breaks just behind the clamping slot, so that only a short free end is left on the empty bobbin.

The clamping slot also lies in a plane which forms an acute angle with the tangential plane lying in the point of intersection between the clamping slot and the bobbin outer surface, on the yarn delivery side. This is particularly suitable for facilitating the entry of the yarn into the clamping slot. This advantage is also achieved by the embodiment of the winding bobbin wherein the side wall of the clamping slot which is located on the yarn delivery side is positioned to be an elongation of the yarn engaging edge of the yarn catching tongue.

The clamping slot preferably has side walls which are inclined with respect to each other to form an acute angle when viewed in plan, which is particularly advantageous in applying high clamping forces to the yarn. This is particularly important in the case of same direction catching since, in addition to the clamping forces for breaking off the yarn, the clamping slot must also apply the delivery forces for delivering the yarn. In addition, this has the result that a tension is built up on the yarn immediately following the entry of the yarn into the clamping slot, so that the yarn is broken off on the yarn discharge side, just after being fixed in position in the clamping slot.

The yarn catching slot may be positioned so as to be spaced from one of the ends of the tubular wall, or it may be in communication with the end of the wall. This latter configuration is particularly advantageous in that it simplifies the formation of the slot.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
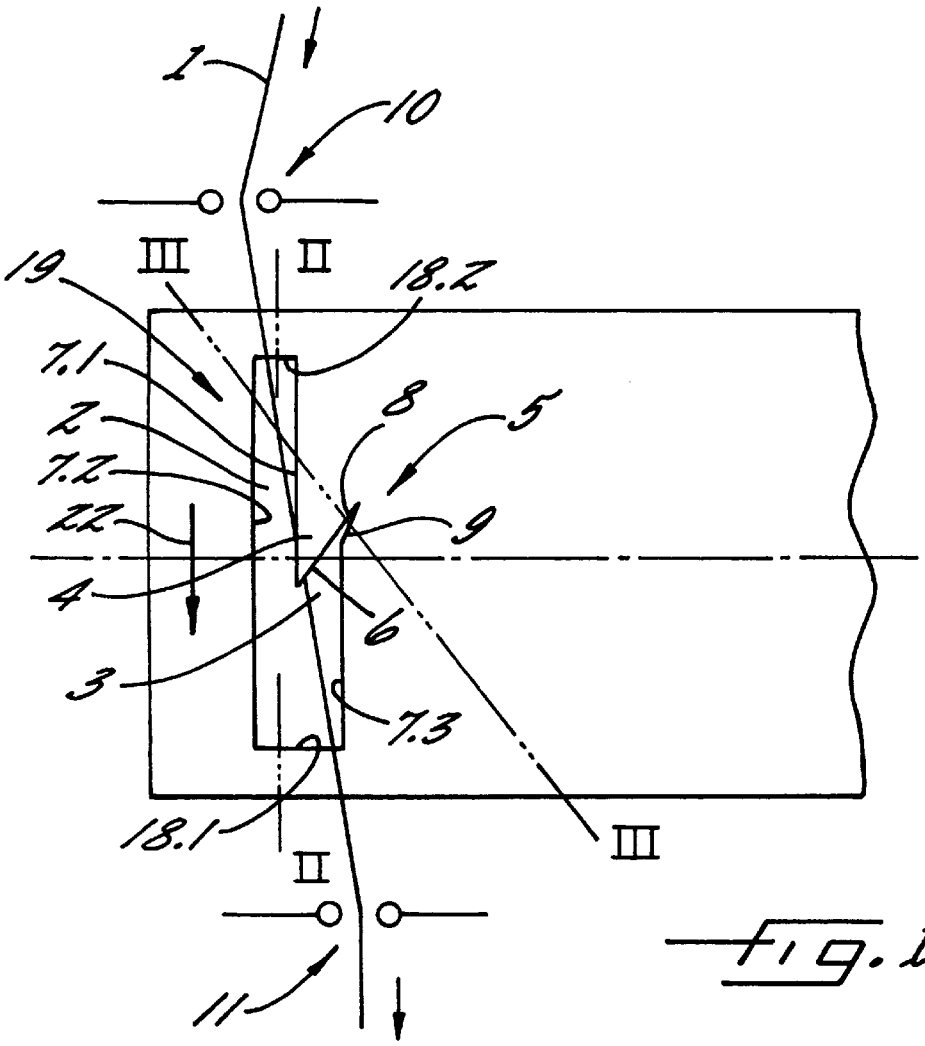
FIG. 1 is a fragmentary plan view showing a yarn winding bobbin according to the invention, with a catching slot and a traversing yarn, shortly before catching.

FIG. 1 shows a cylindrical winding bobbin with a catching slot 19 fashioned at one end, and which embodies the present invention. The catching slot 19 extends in the circumferential direction, parallel to the end of the bobbin, over an angle of about 45° or more. The catching slot 19 is formed by a through opening 2, which is cut into the bobbin wall 12 (see FIG. 2). The through opening 2 is delimited in the axial direction by the side flanks 7.1 and 7.2 and in the circumferential direction by the transverse flanks 18.1 and 18.2. At the end of the catching slot which points in the direction of rotation 22, the through opening 2 is widened towards the axial center of the winding bobbin by a cut-out 3, so as to define a further side flank 7.3 which is parallel to and axially spaced from the side flanks 7.1 and 7.2. The cut-out 3 is also designed so that a yarn catching tongue 4 is fashioned at about the circumferential midpoint of the yarn catching slot, between the cut-out 3 and the through opening 2. The catching tongue 4 has a yarn engaging edge 6, created by the cut-out 3, which, together with the side flank 7.1 of the through opening 2, forms an acute angle pointing in the direction of rotation. Disposed in the transition region between the catching tongue 4 and the cut-out 3 is a clamping slot 5. The clamping slot 5 is cut into the bobbin wall, and extends a substantial distance away from the intersection (which may be imaginary) of the edge 6 and the side flank 7.3.

The clamping slot 5 is aligned in an elongation relative to the yarn engaging edge 6 of the yarn catching tongue. The side walls 8 and 9 of the clamping slot 5 are cut into the bobbin wall in such a way that the slot width across the clamping slot decreases as the cutting depth increases. The side wall 8 of the clamping slot 5 is fashioned so that it is in alignment with the edge 6 of the catching tongue 4. The clamping slot thus lies transversely relative to the normal plane in which the catching slot 19 is disposed.

For the purpose of catching the yarn 1 in the catching slot 19, the yarn moves in the direction of the arrow, which is identical to the direction of rotation 22 of the winding bobbin. Consequently, no relative movements occur between the surface of the winding bobbin contacted by the yarn and the yarn itself. The yarn is then guided obliquely over the surface of the winding bobbin. Thus, for example, in the case of the bobbin winding machine known from EP 0 374 536, the yarn is positioned, prior to catching, between the fully wound package and the empty bobbin by a deflector plate 11, so that the tie-off roll can form on the full package.

On the yarn delivery side of the empty winding bobbin, the yarn is guided by a catching lock 10. The catching lock 10 and the deflector plate 11 are offset relative to one another, so that the yarn 1 runs obliquely over the empty winding bobbin, and the catching slot 19.

Figure 2:
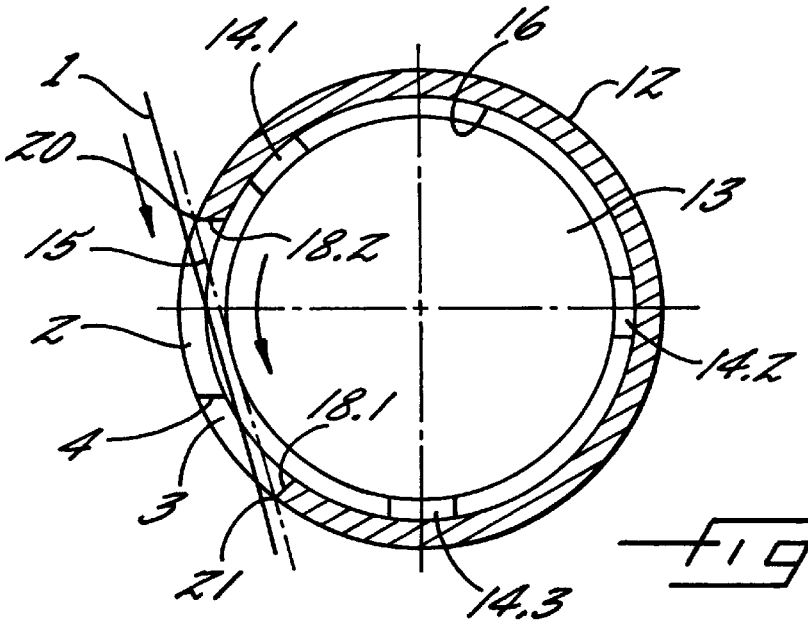
FIG. 2 is a cross section of the winding bobbin according to FIG. 1, taken along the sectional line II.
Figure 4:
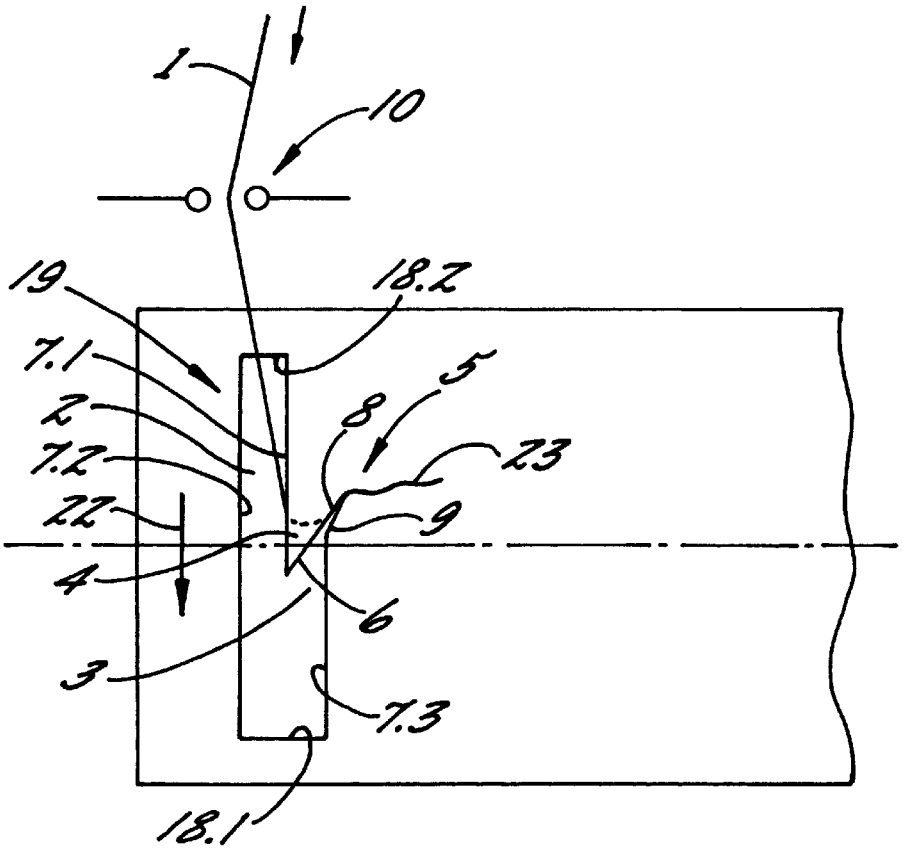
FIG. 4 shows the winding bobbin of FIG. 1 immediately after the breakage of the yarn on the yarn discharge side.

The through opening 2 and the cut-out 3 of the catching slot are dimensioned so that an incoming yarn passes through the catching slot on a secant relative to the inner circumference 16 of the winding bobbin. In this regard, FIG. 2 shows a schematic cross section of the winding bobbin from FIG. 1, along the sectional line II. The wall 12 of the winding bobbin is fixed in position by means of several clamping elements 14.1, 14.2, 14.3. The clamping elements 14.1, 14.2, 14.3 are disposed on a bobbin holder 13 so as to be radially adjustable. The through opening 2 and the cut-out 3 in the bobbin wall 12 are delimited by the transverse flanks 18.1 and 18.2, which form the intake edge 20 and discharge edge 21 located on the surface of the bobbin. A straight line joining the intake edge 20 to the discharge edge 21 represents a secant 15 of the inner circumference 16 of the winding bobbin. By this means, the incoming yarn 1 reaches the central region of the catching slot below the inner circumference 16 of the winding bobbin. As the rotational movement of the winding bobbin progresses, the yarn 1 thus passes below the catching tongue 4. In order that it reliably catches the catching tongue, the yarn dips about 0.3 to 0.5 mm below the inner circumference of the bobbin wall in the central region of the catching slot. As the winding bobbin rotates further, it is no longer possible for the yarn to move radially out of the catching slot. As the rotational movement of the winding bobbin progresses, the yarn is carried along by the catching tongue 4 so that the yarn wraps around the catching tongue and, following discharge from the edge 6, is guided out of the catching slot. Upon further rotation, the yarn will now slide on the edge 6, towards the clamping slot 5. The rotation of the winding bobbin causes the yarn to be drawn automatically into the clamping slot 5. Once the yarn is fixed in position in the clamping slot 5, the yarn tension increases very rapidly due to the rotational movement of the full package and the rotational movement of the empty winding bobbin and the yarn is broken off. This situation is depicted in FIG. 4, with the yarn fixed in position in the clamping slot 5 and the yarn end 23 lying loosely on the surface of the winding bobbin.

Figure 3:
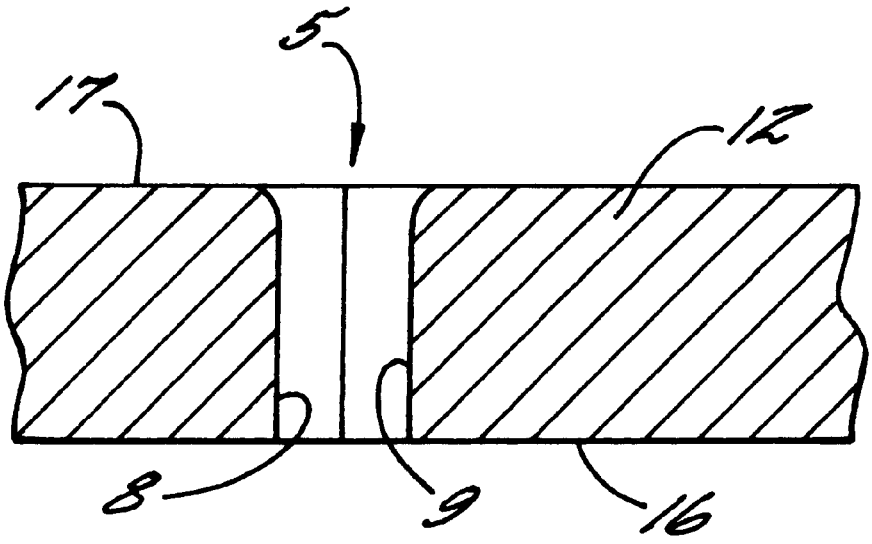
FIG. 3 is a fragmentary section view taken through the clamping slot along the sectional line III.
Figure 3A:
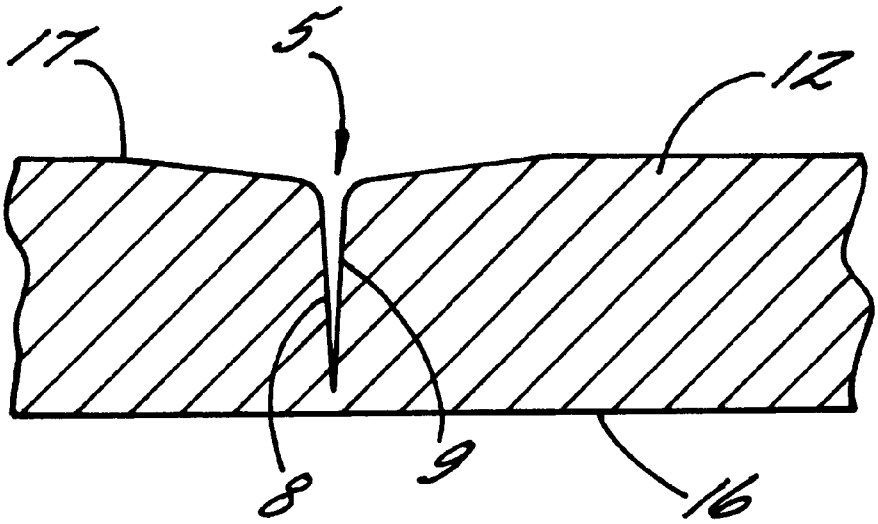
FIG. 3A is similar to FIG. 3 and shows a modified form of the clamping slot.

FIG. 3 schematically depicts a section through the clamping slot 5 of the winding bobbin from FIG. 1, along the sectional line III. Here, the clamping slot 5 in the bobbin wall 12 is formed by the side walls 8 and 9. The clamping slot 5 passes through the entire thickness of the bobbin wall 12. The side walls 8 and 9 run substantially parallel in the radial direction, so that the yarn can easily pass into the narrowing clamping slot. However, the side walls 8 and 9 could also be radially disposed in such a way that they form an acute angle, as seen in FIG. 3A. This would cause a yarn tension to be built up on the discharging yarn, just after the yarn has passed into the clamping slot 5. The forces necessary for delivery of the yarn are very rapidly applied.

Figure 5:
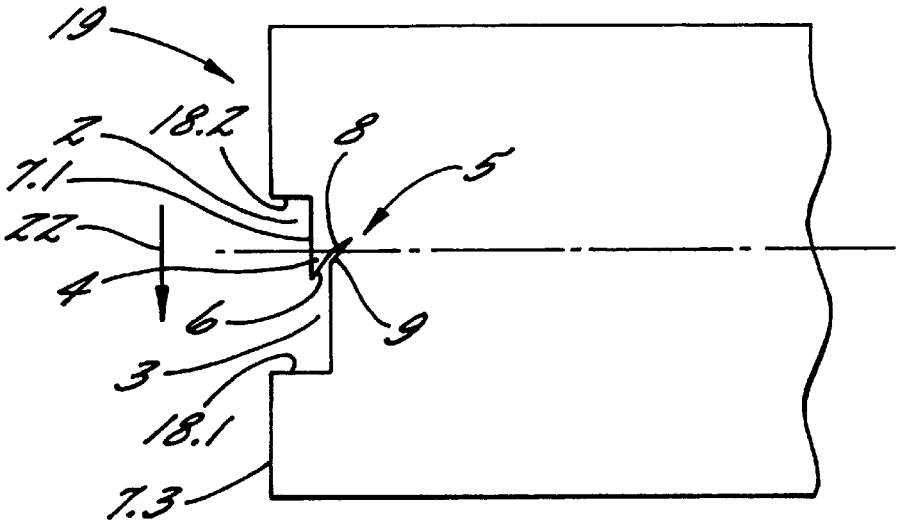
FIG. 5 is a view similar to FIG. 1 and showing a further embodiment wherein the yarn catching slot is fashioned at the end of the bobbin.

FIG. 5 shows a further embodiment of a winding bobbin in accordance with the present invention, in which the yarn catching slot 19 communicates with the end of the bobbin.

The catching slot is thus open towards the end of the bobbin. This embodiment is particularly advantageous for production reasons.

The winding bobbin can be made from cardboard, wound layers of paper or from plastics. The catching slot according to the invention is particularly suitable for winding bobbins made from cardboard, since they can be produced by simple cutting or stamping tools.

Many modifications and other embodiments of the invention will come to mind to one skilled in the art to which this invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A yarn winding bobbin adapted for having a yarn wound thereupon to form a yarn package, and comprising a cylindrical tubular wall defining a longitudinal axis and opposite ends, a yarn catching slot formed in said wall adjacent or in communication with one of said ends and extending in a circumferential direction and completely through said wall into a radial direction, said slot including a side flank which is disposed substantially perpendicular to said axis and a yarn catching tongue which extends from said flank in a generally axial direction and includes a yarn engaging edge which faces in an intended direction of rotation of the bobbin, and a clamping slot formed in the tubular wall and extending a substantial distance away from the intersection of the yarn engaging edge and the side flank of the yarn catching slot, whereby upon rotation of the bobbin about said longitudinal axis, a yarn positioned circumferentially along said yarn catching slot will drop into said yarn catching slot and the yarn will then be engaged by said yarn engaging edge which in turn causes the yarn to slide into and be engaged by said clamping slot.

2. The yarn winding bobbin as defined in claim 1 wherein said yarn engaging edge of said yarn catching tongue is inclined so as to form an acute angle with said side flank.

3. The yarn winding bobbin as defined in claim 2 wherein said yarn catching slot extends circumferentially over an angle of at least about 45 degrees.

4. The yarn winding bobbin as defined in claim 3 wherein said yarn engaging edge of said yarn catching tongue is positioned at about the circumferential midpoint of said yarn catching slot.

5. The yarn winding bobbin as defined in claim 4 wherein said yarn catching slot is of sufficient circumferential extent such that a yarn positioned circumferentially along the yarn catching slot will drop into the yarn catching slot and form a secant which is below the inside circumferential surface of the wall.

6. The yarn winding bobbin as defined in claim 2 wherein said clamping slot extends radially completely through said wall and includes side walls which are sufficiently close together to grip a yarn received therein.

7. The yarn winding bobbin as defined in claim 6 wherein said side walls of said clamping slot extend in a direction having a substantial axial component and are inclined with respect to each other so as to form an acute angle when viewed in plan.

8. The yarn winding bobbin as defined in claim 7 wherein one of said side walls of said clamping slot forms a continuation of said yarn engaging edge.

9. The yarn winding bobbin as defined in claim 2 wherein said yarn catching slot is spaced from said one end of said tubular wall and includes an opposite side flank which extends the circumferential length of the yarn catching slot and opposes said first mentioned side flank.

10. The yarn winding bobbin as defined in claim 2 wherein said yarn catching slot communicates with said one end of said tubular wall and such that the yarn catching slot is open on the side opposite said side flank.

11. The yarn winding bobbin as defined in claim 2 wherein said yarn clamping slot includes side walls which are inclined with respect to each other so as to form an acute angle when viewed in plan and which is smaller than the acute angle formed between said yarn engaging edge of said yarn catching tongue and said side flank.

* * * * *